US005088723A

United States Patent [19]

Simmons

[11] Patent Number: 5,088,723

[45] Date of Patent: Feb. 18, 1992

[54] SUBMERGIBLE AQUATIC FLOTATION DEVICE

[76] Inventor: Thomas R. Simmons, 3510 Lobit, Dickinson, Tex. 77539-4310

[21] Appl. No.: 620,559

[22] Filed: Dec. 3, 1990

[51] Int. Cl.[5] ..... A63G 19/00

[52] U.S. Cl. ..... 272/1 B; 5/453; 441/130

[58] Field of Search ..... 272/1 B; 5/453, 455, 5/480, 449; 441/40, 85, 125–130

[56] References Cited

U.S. PATENT DOCUMENTS 4,901,386 2/1990 Lane ..... 5/450
4,953,247 9/1990 Hasty ..... 5/453
4,962,921 10/1990 Simmons ..... 272/1 B

*Primary Examiner*—Richard E. Chilcot, Jr.
*Attorney, Agent, or Firm*—Marvin J. Marnock

[57] ABSTRACT

An inflatable aquatic device suitable for supporting a person in reclined position thereon when inflated. The device comprises at least one pair of elongated inflatable tubular members 61, 62 of substantially equal length and configuration which are interconnected by pliant spacer members 63 for maintaining the inflatable tubular members in spaced relationship, substantially symmetrical about the longitudinal axis of the device, and for providing, with said inflatable tubular member, a support wherein the person's body is supported with a substantially minimal areal contact with the spacer members. The aquatic device is comprised of sections which are flexible connected at their adjoining ends and adapted to support the lower legs, thighs, and torso of the person reclined thereon. A conduit 65 in fluid communication with the inflatable members and a valve 68 installed in the conduit provide a means controllable by a person reclined on the device for adjusting the level of buoyancy and the depth of submersion of said different sections of the device and their relative angles of inclination to assume a preferred position suitable for rest or as an initial position for exercise.

11 Claims, 2 Drawing Sheets

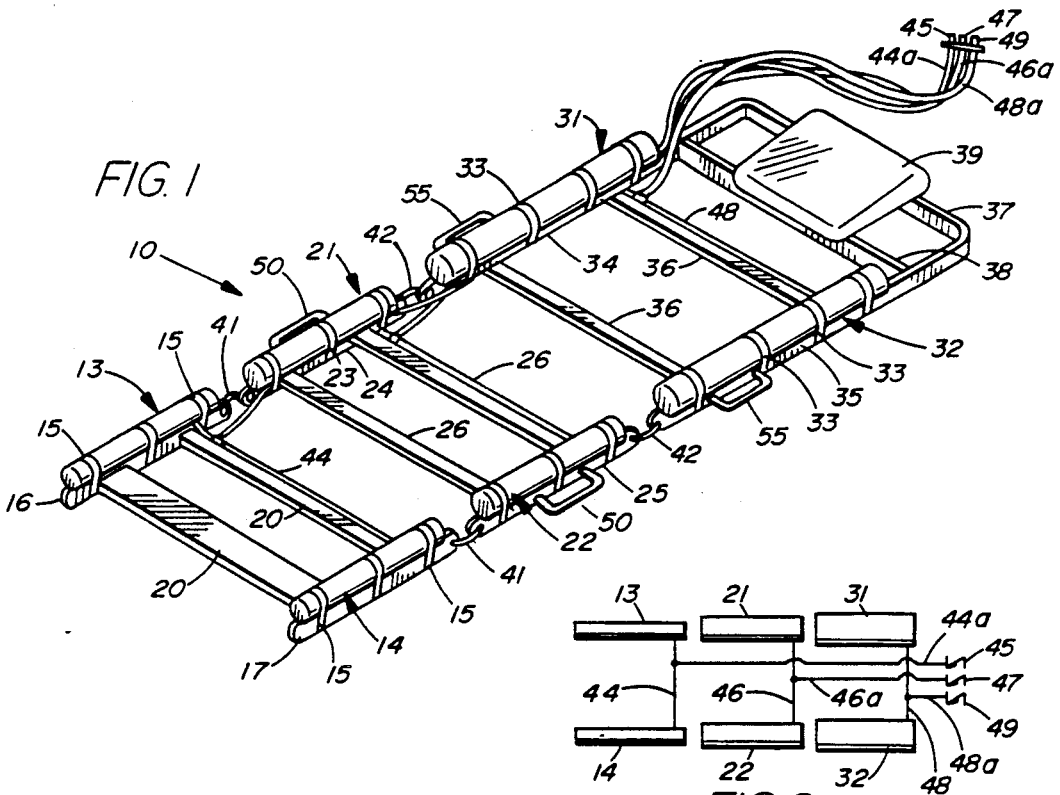
FIG. 2
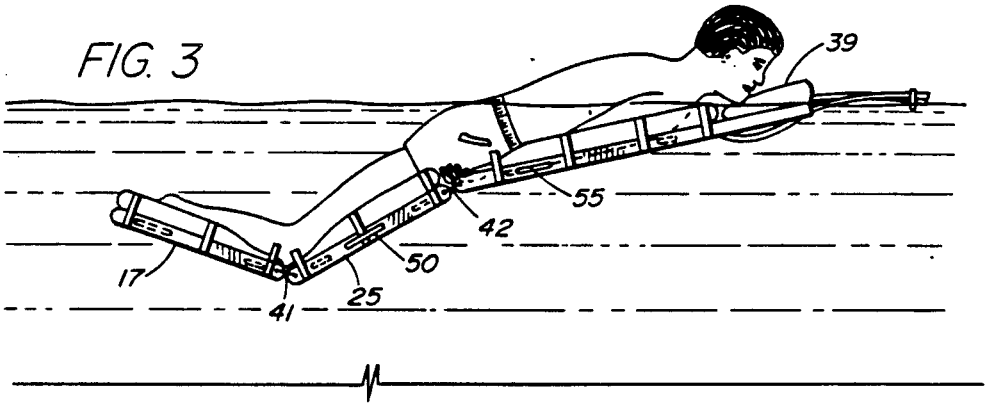
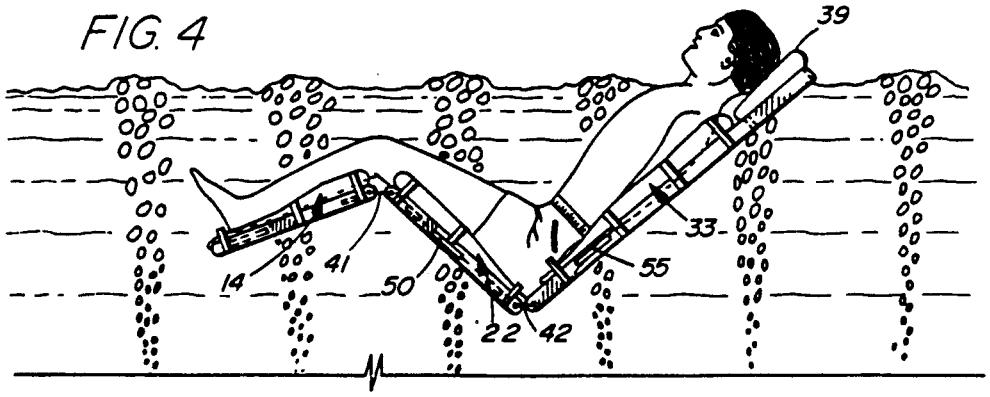

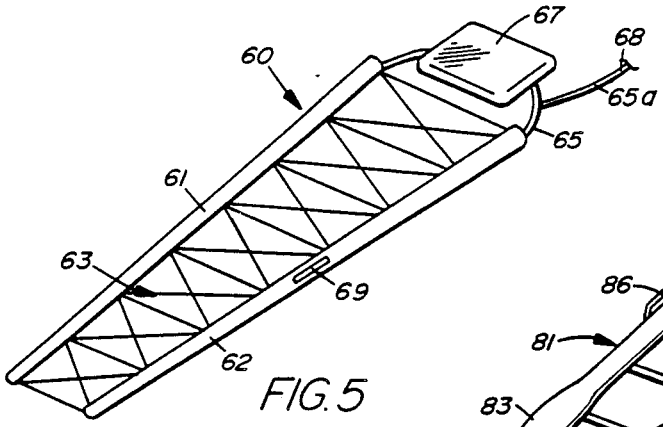
FIG. 5
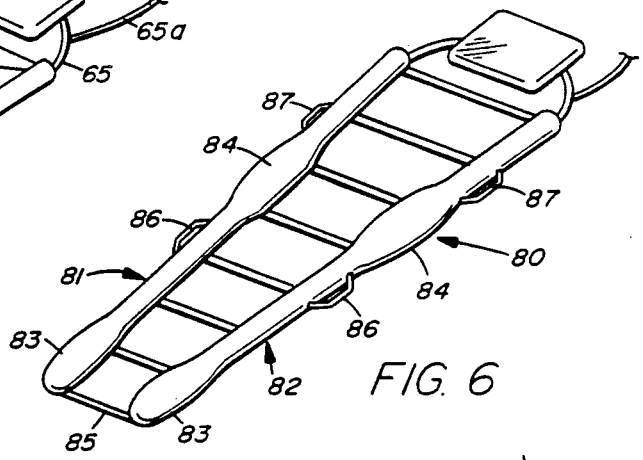
FIG. 6
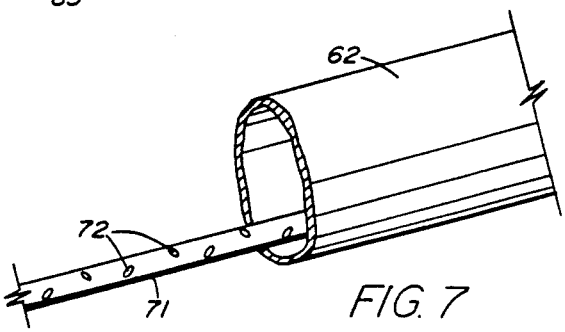
FIG. 7
FIG. 8
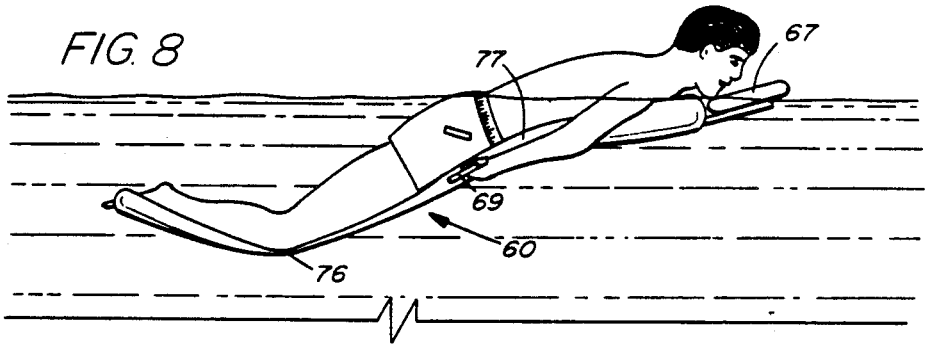
FIG. 9
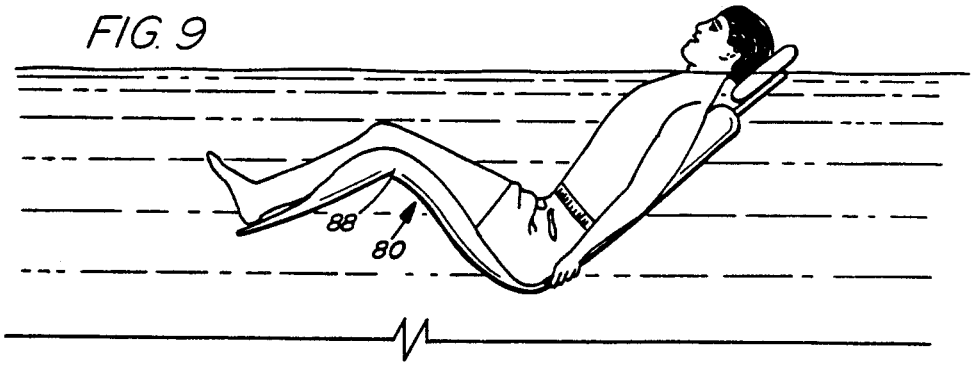

SUBMERGIBLE AQUATIC FLOTATION DEVICE

FIELD OF THE INVENTION

This invention relates to inflatable aquatic devices which are adapted to support a person thereon, and more particularly to an inflatable aquatic device comprised of torso, thigh and lower leg supporting sections and means whereby a person reclined on the device can adjust the levels of buoyancy and submergence of the supporting sections to assume a preferred underwater position.

BACKGROUND OF THE INVENTION

Inflatable devices for recreation and exercise which are adapted to support a person thereon have been devised in a variety of forms. The prior art is rife with inflatable mattress pads or other buoyant pads which are of a size sufficient to support a person in reclined position thereon. One such flotation device is shown in U.S. Pat. No. 4,962,921. Generally, it is characteristic of the prior art devices that when a person is reclined on such a pad, the side of the person which contacts the pad does not directly contact the water on which the pad is floated and he is therefore precluded from any soothing or therapeutic effects as might be conveyed to him by contact with the water. This is particularly so if the pad is floated in a pool of water, such as a spa, wherein jets of water and air are directed into the water to massage and soothe the person's body. Some of the prior art devices permit a partial submergence of the body, with the legs of the person angled with respect to the torso in a form of sitting position. None of the prior art devices, however, disclose any means for adjusting the buoyancy of the flotation device when in the water, and particularly the relative buoyancies of the different body supporting sections, such as the torso and leg supporting sections, as would allow an adjustment of the relative inclinations of these sections and their levels of submergence by the person when reclined thereon.

SUMMARY OF THE INVENTION

The invention is an inflatable aquatic device which is of a length and configuration suitable for supporting a person in reclined position thereon when inflated. The aquatic device comprises at least one pair of elongate inflatable tubular members of flexible, pliant material which are of substantially equal length and configuration. The inflatable tubular members of each said pair are interconnected by pliant spacer members for maintaining the inflatable tubular members in a spaced relationship, substantially symmetrical about the longitudinal axis of the device, and for providing, with said inflatable tubular members, a body support wherein the person's body is supported with a substantially minimal area of contact with the spacer members. The aquatic device is comprised of a lower leg supporting section, a thigh supporting section and a torso supporting section for supporting the lower legs, thighs, and torso of the person respectively, and which sections are flexibly connected at their adjoining ends. The aquatic device is further provided with a conduit in fluid communication with the inflatable members and a valve installed in the conduit, which valve is readily accessible to and controllable by a person in reclined position on the device whereby he may adjust the level of buoyancy and the depth of submersion of said different sections of the device and their relative angles of inclination by bleeding air out of the tubular members or blowing more air into said tubular members to assume a preferred partially submerged position suitable as a position for rest or as an initial position for exercises. Preferably a buoyant headrest is attached to the torso support section at one end of the device so that the head of a person on the device is maintained above water.

BRIEF DESCTIPTION OF THE DRAWINGS

FIG. 1 is a perspective view of a first embodiment of an inflatable aquatic device constructed in accordance with the invention;

FIG. 2 is a schematic block diagram which illustrates the elongate inflatable tubular members in the aquatic device of FIG. 1, as they are arranged in pairs in adjoining end-to-end relationship and provided with interconnecting fluid communicating conduits by which the inflating medium can be supplied or withdrawn;

FIG. 3 is a side view of the device of FIG. 1 when placed in a pool of water with a person reclined and supported thereon in a face-down position with different supporting sections of the device at different levels of submergence and at relatively inclined angles to one another;

FIG. 4 is a view similar to FIG. 3 but wherein the aquatic device of the invention is placed in a spa with a person supported thereon in an approximate sitting position;

FIG. 5 is a perspective view of a second embodiment of the invention;

FIG. 6 is a perspective view of a third embodiment of the invention;

FIG. 7 is a fragmentary section view of an inflatable tubular member which may be used in the embodiments of the invention illustrated in FIGS. 5 and 6;

FIG. 8 is a side view of the embodiment of the invention as shown in FIG. 6 and when placed in a pool of water with a person supported thereon in face-down position; and FIG. 9 is a view similar to FIG. 8 but wherein the person is reclined thereon in face-up position and supported in a relative sitting position by different sections of the device at different levels of submergence and at relative inclined angles.

DETAILED DESCTIPITON OF THE INVENTION

Referring more particularly to the drawings, there is shown in FIG. 1 an inflatable aquatic device 10 which represents a first embodiment of the invention. The device 10 comprises a plurality of elongate inflatable tubular members of non-porous, flexible and substantially inelastic material, arranged in pairs as shown in FIG. 2. The tubular members 13,14 of the first pair are mounted lengthwise as by straps 15 on elongate base members 16,17 respectively, which are substantially of equal length with the tubular members 13,14. The base members 16,17, which are of a light weight plastic or other buoyant material, are joined in a substantially parallel relationship by spacer members 20 of a pliant, flexible plastic material which are adapted to flexibly yield to a weight supported thereon but will generally maintain the tubular members 13,14 in their spaced, parallel relationship symmetrical with respect to the longitudinal axis of the device. The spacer members may be bonded to the base members by a suitable bonding agent or by heat fusion.

A second pair of inflatable tubular members 21,22 are mounted lengthwise by straps 23 on base members 24,25, respectively, which are of substantially equal length with the tubular members 21,22. The tubular members 21,22 are maintained in substantially parallel spaced relationship by pliant spacer members 26, similar to the space members 20.

A third pair of inflatable tubular members 31,32 are mounted lengthwise by straps 33 on base members 34,35, respectively, which are interconnected by pliant spacer members 36, similar to spacer members 20,26, for maintaining the tubular members 31,32 in substantially parallel spaced relationship. The base members 34,35 are the legs of a U-shaped member having a cross span beam 37 and an adjacent parallel cross span beam 38. The cross spans 37,38 provide support for a buoyant headrest or pillow 39 which is mounted centrally thereon. The pillow 39 is of buoyant material, such as foam plastic, or it could be an inflatable device.

As shown in FIG. 1, the base members 16,17 are flexibly connected to the base members 24,25 at their respective adjacent paired ends by flexible straps 41. In like manner, the base members 21,22 are flexibly connected to the base members 34,35 at their respective adjacent paired ends by flexible straps 42.

The paired tubular members 13,14 are connected in fluid communication by a flexible conduit 44 and are inflatable by means of a flexible branch conduit **44*a* which connects to the conduit 44 and is provided at its distal end with a normally closed check valve or reed valve 45 for controlling the flow of an inflating medium into or out of the tubular members 13,14. The length of the conduit 44*a* is such that the valve end of the conduit is easily accessible to a person in reclined position on the aquatic device 10 whereby the person may work the valve to further inflate the tubular members 13,14** by blowing through the valve or to release some of the inflating medium, in a procedure and for purposes to be hereinafter described.

In like manner, the paired tubular members 21,22 are connected in fluid communication by a flexible conduit 46 and are inflatable by means of a flexible branch conduit **46*a* which connects to the conduit 46 and is provided at its distal end with a normally closed check valve or reed valve 47. The conduit 46*a* is of sufficient length that its valve 47 is accessible to a person in reclined position on the aquatic device 10**.

The third pair of inflatable tubular members 31,32 are similarly provided with a fluid communicating conduit 48, branch conduit **48*a* and a valve 49 installed on the end of the conduit 48*a*. The branch conduits 44*a*,46*a*,48*a* are adapted to float on the water with their valve ends near the pillow 39 so as to be readily accessible to the mouth of a person in reclined position on the device 10**.

The valves 45, 47, 49 are preferably identical, and may be of a commercially available type, formed of a soft plastic, with a valve element flexibly connected to the valve body. The valve element is adapted to work as a reed valve element or check valve element which is in normally closed position but responds to move to open position on the application of externally applied pressure. Preferably, the valves are such that a person can open the valve by placing his lips to one end of the valve body and applying lung pressure thereto and thereby inflate the tubular members. Since the valve is of soft plastic, the valve element can also be unseated from its closed position to release inflating medium from the tubular members by squeezing the soft valve body adjacent the attachment location of the valve element.

It is shown in FIG. 3, that the pair of tubular members 13,14 and the spacer members 20 form a section of the aquatic device 10 which is adapted to support the lower legs of a person reclined on the device 10. The pair of tubular members 21,22 with spacer members 26 form an intermediate section of the aquatic device 10 which is adapted to support the thighs of a person reclined on the device 10 with the tubular members 21,22 being of slightly greater diameter and size than the tubular members 13,14 in order to provide a greater buoyancy capability for supporting the greater weight of the thighs.

In like manner, the tubular members 31,32 with spacers 36 form a third section of the aquatic device 10 which is adapted to support the torso of a person when reclined thereon with his head on the pillow 39. The tubular members 31,32 are of greater size and capacity than the other pairs of inflatable tubular members in order to provide greater buoyancy for supporting the torso section.

As shown in FIG. 3, a person may assume a partially submerged position on the device 10 in an attitude of position determined by the respective buoyancies of the leg supporting section, the thigh supporting section and the torso supporting section. The person may adjust his position when in the water by adjusting the degree of inflation of an associated pair of tubular members relative to the degree of inflation of an adjoining pair of inflatable tubular members. By so doing, the person can adjust the relative levels of buoyancy of the leg, thigh and torso supporting sections and their relative inclination to one another and thereby assume a desired position which may be comfortable for resting. The person may also choose a position suitable for practicing a particular exercise, such as knee-bends, which may therefore be performed when in a generally submerged position except for his head which is supported above water by the pillow 39. To facilitate such exercises a pair of handles 50 may be attached to the outside of the base members 24,25 and a similar pair of handles 55 provided for the base members 34,35. The handles may also be used to maintain balance and stability.

A significant feature of the aquatic device 10 is that the spacer members 20,26 and 36 are widely spaced relative to one another. Accordingly, there is relatively small area contact of the person's body with the aquatic device 10 when reclined either face-upward or face-downward thereon and his body is predominantly exposed to the water around him and he is not therefore precluded from soothing contact with the water. When in a spa, he is therefore more substantially exposed to the pressured jets of air and water than if he were reclined on a conventional air mattress or flotation pad.

In FIG. 5 there is shown a second embodiment of the invention wherein an aquatic device 60 is provided with only a single pair of elongate inflatable tubular members 61,62. The tubular members 61,62, which are formed identical, are provided when inflated with a uniformly decreasing taper which is largest at the head end of the aquatic device. The inflatable tubular members 61,62 are maintained in spaced relationship, which is wider at one pair of ends than the other, by a netting 63 of a pliant, flexible plastic material which provides sufficient rigidity to maintain a spaced relation of the tubular members 61,62 even though a body weight is supported thereon. The netting 63 is formed of pencil-like strands of pliant, flexible material and provides even less areal contact with a person's body than do the spacer members 21, 26 and 36 of the first embodiment of the invention. A light weight, rigid conduit 65 interconnects the wide spaced ends of the tubular members 61,62 to provide fluid communication therebetween and also provide a support for a headrest such as a pillow 67 which may be bonded thereto or attached thereto in any suitable manner. A branch conduit 65*a* connects with the conduit 65 and is provided with a valve 68 at the end thereof which is similar to the valves 45, 47, 49 and can be easily placed to the lips of a person reclining on the aquatic device 60 for adjusting the degree of inflation of the tubular members. A pair of handles 69 are also placed on the exterior sides of the members 61,62 at a location which is approximately at the mid-points between their ends.

As shown in FIG. 7, the conduit 65 is provided with a pair of flexible conduit extensions 71, each with perforations 72 formed therein substantially throughout its full length. Each of the tubular members 61,62 is provided with one of the flexible perforated conduits 71 which extends through the interior of the tubular member substantially throughout its full length. In each tubular member 61,62, the perforated conduit 71 allows a flexure or bending of one section of the inflatable tubular member relative to another adjacent section without a pinching off of fluid communication therebetween. Accordingly, when the aquatic device 60 is placed in a pool of water and a person is reclined thereon, as shown in FIG. 8, the sections of the tubular members 61,62 and the netting 63 which support the lower legs assume an angled position relative to the thigh supporting sections of the tubular members 61,62 with a flexure 76 occurring in each tubular member at the location of the knees. The relative angle between the two sections is a function of the degree of inflation of the tubular members and the relative buoyancies of each section as influenced by the weight of the lower legs compared to the weight of the thighs. The person reclined on the device 60 by blowing through the valve 68 can simultaneously adjust the degree of inflation of both tubular members 61,62 and therefore the levels of submergence of the two sections. In practice it is to be observed that the relative angle between the two sections will become more acute as the tubular members 61,62 become less inflated.

It is also to be seen in FIG. 8, that a flexure 77 of the tubular members 61,62 also occurs in the vicinity of the person's hips such that the portion of the tubular member between the flexures 76,77 is a part of the thigh supporting section whereas the portion of the tubular member from the flexure 77 to the headrest 67 is a part of the torso supporting section. As with the angle of the flexure 76, the relative angle between the thigh and torso supporting sections at the flexure 77 is a function of the relative buoyancies of the adjoining sections and their degree of inflation.

It is therefore to be seen that a person on the device 60 can assume a position as shown in FIG. 8 and modify his position by operation of the valve 68 to either decrease or increase the inflation of the tubular members 61,62. He can also initiate exercises from this position by flexing his body at the knees and hips which he can facilitate by grabbing the handles 69 and using arm power in opposing buoyancy and water pressure to assist the flexure.

A third modified form of the invention is represented by the aquatic device 80 shown in FIG. 6. The aquatic device 80 differs principally from the device 60 of FIG. 5 by the provision of larger diameter sections 83,84 of the inflatable tubular members 81,82 at the foot end of the device and at the end portions of the thigh supporting sections which adjoin the leg supporting sections. The inflatable members 81,82 are otherwise identical to the inflatable members 61,62 of the device 60 shown in FIG. 5 and are also provided with a perforated conduit extending lengthwise therethrough, such as the conduits 71. Spacer members 85, similar to the pliant, flexible spacer members 21,26 and 36 of the device of FIG. 1 are used to interconnect and maintain the tubular members 81,82 in spaced relation. A pair of handles 86 is also provided on the exterior sides of the tubular members 81,82 at approximately the lower end of the thigh supporting sections and a similar pair of handles 87 is provided at approximately the lower end of the torso supporting section.

The aquatic device 80 functions in basically the same manner as the aquatic device 60 with the exception that the large diameter bulbous portions 83,84 each provides for a rapid flow of a relatively large volume of air from one support section to another when the flexure joint therebetween is elevated, such as the flexure joint 88 in the device 80 shown in FIG. 9. When performing exercises, particularly when gripping the handles 86 or 87, an occupant of the aquatic device 80 can use his muscle power to manipulate the device 80 so as to cause the rapid transfer of air and buoyancy from one section of the device to the other and thereby accomplish more rapid changes in the submersion levels of the different sections and accompanying rapid changes in body position than are attainable by use of the aquatic device 60. The transfer of large volumes of air from the support sections at greater depths to those at more shallow depths, which transfer is enhanced by the variance of water pressure between such depths, serves to emphasize the "rocker" action of the device, particularly when induced by an occupant when the handles are used in performing an exercise or in effecting its manipulation.

It is therefore to be seen that an inflatable aquatic device is disclosed herein which is adapted to support a person reclined thereon and which is provided with means whereby the person can readily adjust the levels of buoyancy and submergence of different sections thereof to assume a partially submerged position preferred as a positional attitude for rest or as an initial position for commencement of exercise.

It is also to be understood that the foregoing description of the invention has been presented for purposes of illustration and explanation and is not intended to limit the invention to the precise forms disclosed. It is to be appreciated therefore that various material and structural changes may be made by those skilled in the art without departing from the spirit of the invention.

I claim:

1. An inflatable aquatic device of a length and configuration adapted to support a person in reclined position thereon when inflated, said device comprising:

at least one pair of elongate inflatable tubular members of flexible pliant material and substantially equal length and configuration;

a plurality of pliant spacer members interconnecting the inflatable tubular members of each said pair for maintaining the interconnected tubular members in spaced relationship substantially symmetrical about the longitudinal axis of the aquatic device, and wherein said spacer members provide minimal areal contact with the body of a person reclined thereon such that when said device is placed in a spa or other pool of water, the person's body is predominantly exposed to water and the bubbling, massaging jets which may be provided therein;

said aquatic device including said tubular members and spacer members being comprised of a torso support section for supporting the torso of a person, a thigh support section adjoining the torso support section for supporting the thighs of a person, and a leg support section adjoining the thigh section for supporting the lower legs of a person, each said section being flexibly connected to the next adjoining section;

buoyancy adjustment means controllable by a person reclined on said aquatic exerciser device for adjusting the degree of inflation of each said inflatable tubular member and thereby the level of buoyancy of each said support section in correspondence with the weight of the portion of the person's body supported thereon when said device is floated in a body of water whereby a person reclined on the aquatic device can submerge said support sections at relatively inclined angles and different levels of submergence to assume partially submerged position which is preferred for an attitude of rest or as an initial position suitable for commencement of exercise.

2. An inflatable aquatic device as set forth in claim 1 further including a buoyant head-rest member affixed to said torso support section at one end of the device whereby a person reclined on the aquatic device can submerge said torso, thigh, and leg support sections at relatively inclined angles and his own body thereon while retaining his head above water.

3. An inflatable aquatic device as set forth in claim 1 wherein said buoyancy adjustment means includes a conduit which connects said inflatable tubular members in fluid communication and an extension of said conduit provided with a valve installed therein, said conduit extension being of such length and the valve being installed therein at a floating location so that said valve is readily accessible to a person in reclined position on said device for adjusting the degree of inflation of the inflatable tubular member and the buoyancy of each said support section.

4. An inflatable aquatic device as set forth in claim 3 wherein said conduits extension and valve installed therein are located in a normally floating condition such that said valve is readily accessible to the mouth of a person in reclined position on said device.

5. An inflatable aquatic device as set forth in claim 1 wherein said device comprises three pairs of elongate inflatable tubular members with said torso support section, thigh support section and leg support section each provided with its own pair of inflatable tubular members connected in fluid communication and maintained in spaced relation by said pliant spacer members, each said pair of inflatable tubular members being connected to the adjoining inflatable tubular members of the adjoining support section by flexible connecting means to provide a flexible joint therewith.

6. An inflatable aquatic device as set forth in claim 5 wherein each pair of inflatable tubular members of said torso support section, said thigh support section and said leg support section is provided with a conduit connecting the members of each pair in fluid communication and an extension of said conduit with a valve installed therein, each said conduit extension being of such length and the valve installed therein at a floating location so as to be accessible to a person reclined on said aquatic device for controlling the degree of inflation of each said pair of tubular members and the level of buoyancy of each said support section.

7. An inflatable aquatic device as set forth in claim 6 wherein said conduits extension and valve installed therein are located in a normally floating condition such that said valve is readily accessible to the mouth of a person in reclined position on said device.

8. An inflatable aquatic device as set forth in claim 6 wherein the inflatable tubular members of at least one of said support sections are each provided with a handle to provide a pair of handles which can be readily grasped by a person reclining on said device to aid in maintaining balance and stability and to enhance exercise movements of said person.

9. An inflatable aquatic device as set forth in claim 1 wherein said device is comprised of only a single pair of elongate inflatable tubular members and said buoyancy adjustment means includes a flexible conduit which interconnects said inflatable tubular members and is provided with a pair of flexible relatively non-collapsible conduit extensions, each of which extends through substantially the entire length of an inflatable tubular member and is provided with numerous perforations at spaced lengthwise intervals along substantially the entire length thereof which is enclosed by the inflatable tubular member whereby fluid communication is maintained for each said inflatable tubular member throughout its entire length even though portions thereof may be collapsed by flexures induced therein by the muscle power of the person supported on said device, said conduit being provided with a valve installed therein at a location which is readily accessible to a person in reclined position on said device whereby the person may adjust the degree of inflation of the inflatable tubular members and the buoyancy of said support sections by opening said valve to release inflating medium from said tubular members or to inject an inflating medium into said tubular members.

10. An inflatable aquatic device as set forth in claim 9 wherein the inflatable tubular members are each provided with a first enlarged diameter portion at the foot end of the leg support section of the device and a second enlarged diameter portion at the end of the torso support section which adjoins the thigh support section whereby when the support sections of said device are manipulated to different depths of water and relative angles of inclination by a person performing exercises on said device, said enlarged diameter portions provide relatively large volumes of air which are adapted to be transferred from said support sections of said device which are at greater depth and external water pressure to the support sections at more shallow depth such that said person may induce and enhance a "rocker" action of the device for purposes of recreation or exercise.

11. An inflatable aquatic device as set forth in claim 1 wherein at least one of said support sections is provided with a pair of handles and each of said handles is fixed to a different one of said inflatable tubular members in a location such that said pair of handles can be readily grasped by a person reclining on said device to aid in maintaining balance and stability and to enhance exercise movements of said person.

* * * * *